US005253739A

United States Patent [19]

King

[11] Patent Number: 5,253,739

[45] Date of Patent: Oct. 19, 1993

[54] WHEELED FLIGHT BAG WITH RETRACTABLE PULL HANDLE

[75] Inventor: William L. King, Denver, Colo.

[73] Assignee: Samsonite Corporation, Denver, Colo.

[21] Appl. No.: 854,504

[22] Filed: Mar. 19, 1992

[51] Int. Cl.[5] ..... A45C 5/14

[52] U.S. Cl. ..... 190/18 A; 190/115

[58] Field of Search ..... 190/18 A, 39, 115; 16/18 CG, 47, 49; 280/47.26, 47.315, 47.371

[56] References Cited

U.S. PATENT DOCUMENTS

| | | | |
|---|---|---|---|
| Re. 29,036 | 11/1976 | Hager . | |
| 746,816 | 12/1903 | Goddard . | |
| 759,299 | 5/1904 | Myers . | |
| 1,028,178 | 6/1912 | Batchelor . | |
| 2,472,491 | 6/1949 | Quinton . | |
| 2,488,222 | 11/1949 | Morgan . | |
| 2,581,417 | 1/1952 | Jones . | |
| 2,925,283 | 2/1960 | Stilger . | |
| 3,257,120 | 6/1966 | Browning . | |
| 3,296,650 | 1/1967 | Eurey et al. . | |
| 3,522,955 | 8/1970 | Warner, Jr. . | |
| 3,606,372 | 9/1971 | Browning . | |
| 3,799,568 | 3/1974 | Hager . | |
| 3,807,817 | 4/1974 | Black | 16/45 |
| 3,842,953 | 10/1974 | Royet . | |
| 3,917,038 | 11/1975 | Foge et al. | 190/18 A |
| 3,948,365 | 4/1976 | Gregg et al. . | |
| 3,960,252 | 6/1976 | Cassimally . | |
| 4,036,336 | 7/1977 | Burtley . | |
| 4,067,083 | 1/1978 | Greene . | |
| 4,087,102 | 5/1978 | Sprague . | |
| 4,228,877 | 10/1980 | Cothary | 190/18 A |
| 4,256,320 | 3/1981 | Hager . | |
| 4,261,447 | 4/1981 | Arias et al. . | |
| 4,299,313 | 11/1981 | Null . | |
| 4,314,624 | 2/1982 | Royet . | |
| 4,321,727 | 3/1982 | Sheiman et al. . | |
| 4,340,132 | 7/1982 | Cerna . | |
| 4,358,006 | 11/1982 | Castelli . | |
| 4,406,353 | 9/1983 | Walker . | |
| 4,463,840 | 8/1984 | Seynhaeve . | |
| 4,561,527 | 12/1985 | Winter et al. . | |
| 4,575,109 | 3/1986 | Cowdery . | |
| 4,588,055 | 3/1986 | Chen . | |
| 4,618,035 | 10/1986 | Mao . | |
| 4,621,404 | 11/1986 | Browning . | |
| 4,759,431 | 7/1988 | King et al. . | |
| 4,792,025 | 12/1988 | Thomas . | |
| 4,890,705 | 1/1990 | Pineda . | |
| 4,979,598 | 12/1990 | Verheij et al. . | |
| 4,995,487 | 2/1991 | Plath . | |
| 5,024,455 | 6/1991 | Schrecongost . | |
| 5,048,649 | 9/1991 | Carpenter et al. | 190/115 |
| 5,075,925 | 12/1991 | Maloney . | |
| 5,108,119 | 4/1992 | Huang . | |

FOREIGN PATENT DOCUMENTS

| | | |
|---|---|---|
| 2030966 | 4/1980 | United Kingdom . |

*Primary Examiner*—Gary E. Elkins

*Attorney, Agent, or Firm*—Gregory W. O'Connor; John R. Ley

[57] ABSTRACT

A "flight bag" style carry-on bag incorporates a pair of wheels positioned at a bottom corner of the bag and spaced along the width dimension of the bag. A pull handle is integrated with the bag, and preferably both the pull handle and the wheels are attached to an internal support structure such as a bottom pan. The wheels have an exterior surface presenting an edge upon which the wheels roll at the furtherest spaced apart locations to increase the width of lateral support provided by the wheels. The pull handle assembly includes at least one rod moving in a channel with a slider member connected to the rods to effectively transmit torque between a grip connected to the rod and the internal support structure.

31 Claims, 5 Drawing Sheets

16
17
46
54
58
64
65
66
67
68
69
70
72

WHEELED FLIGHT BAG WITH RETRACTABLE PULL HANDLE

This invention relates to wheeled luggage cases, and more particularly to a new and improved carry-on luggage case of the flight bag type having wheels at one corner of the case and a retractable handle for pulling the case on its wheels along a supporting surface.

BACKGROUND OF THE INVENTION

Wheeled luggage cases are popular with many travelers because they may be pulled rather than carried, thereby making travel more convenient. Wheels are typically used on larger luggage cases which are often too bulky or too heavy for most travelers to carry easily. However, the convenience of wheeled luggage is a significant appeal to users of a variety of sizes and configurations of luggage cases.

Carry-on luggage is popular with travelers who are trying to reduce travel time by foregoing large luggage cases which must be checked for handling in preference for smaller luggage cases which will fit beneath the seat, in an overhead compartment, or hang in a small closet on an airplane or other transportation vehicle. Most carry-on luggage is of the soft sided variety, which consists of an inner rigid frame surrounded by an outer shell made of pliable materials such as leather or vinyl. U.S. Pat. No. 3,977,501, assigned to the assignee of the present application, discloses an example of a soft sided luggage case. Soft sides cases offer a number of advantages when used as carry-on luggage. They are lighter than hard sided cases of comparable size and their flexibility allows the bags to fit into small or irregularly shaped spaces where comparable hard sided bags could not fit. The lighter weight and flexibility is particularly important to travelers who must be able to fit their carry-on luggage in the small and elevated storage spaces provided by an airplane or other transportation vehicle.

Perhaps the most widely used form of carry-on luggage is a garment bag. The flexibility of a garment bag allows a traveler to fit it into a small and crowded closet on a transportation vehicle or, when necessary, to fold the bag for storage in a small space such as an overhead compartment. However, garment bags are not conducive to carrying large, heavy or bulky items. Heavy or bulky items placed within the garment bag may wrinkle the garments being transported. If the bulky items are sufficiently large, there is not convenient place to store them within the garment bag.

Attempts have been made to allow bulky items to be packed effectively in a garment bag. As disclosed in U.S. Pat. No. 4,662,513, assigned to the assignee of the present application, a garment bag incorporates corner compartments to pack rigid items such as shoes in the non-utilized space above the shoulders of garments supported within the bag. U.S. Pat. No. 4,693,368, also assigned to the assignee of the present application, describes a garment bag which may be folded over an integrated packing case for easy transport by a user. While such a combined case offers greater packing capacity for rigid or bulky items than the more typical garment bags, the capacity to carry larger and more bulky items is obviously not as great as typical suitcase style luggage of comparable size.

Most garment bags must be carried by a user, usually with a shoulder strap or from a handle while the bag is folded. Attempts have been made to incorporate dollies with garment bags to allow a user to roll rather than carry the garment bag. Although the dolly structure may be partially collapsible, such structure adds substantially to the weight and bulk of the garment bag and inevitably causes a loss of convenience. Additionally, the dolly structure normally requires the traveller to unfold the garment bag to the extended position, connect it to the extended dolly structure, and roll the garment bag along in an upright posture. The large extended configuration of the garment bag makes it difficult to maneuver and demands a great deal of room which is often not available in crowded or confined passenger terminals.

Despite the popularity of carry-on garment bags, many people desire a "flight bag" style of carry-on case, either in addition to or in place of a garment bag. The size and shape of the flight bag allows heavier or bulkier items to be more easily accommodated and the flexibility of the bag allows for storage within the confined spaces available on transportation vehicles. The flight bag combines many of the advantages of soft sided carry-on luggage with the familiar size and shape of more typical smaller suitcase type luggage cases.

To enhance the packing capacity of a typical flight bag type of soft sided carry-on case, the width dimension is slightly increased compared to a standard suitcase. The added width is more likely to cause the user carrying the bag in a typical manner to scuff or scrape the bag along the side of his or her body or leg, or to require more effort to hold the bag further outward from the body to avoid scuffing or scraping.

To avoid these problems associated with flight bags, and to achieve the convenience of wheeled luggage, separate portable caddies and integrated wheel and handle structures both have been used with flight bags. A portable wheeled luggage caddie creates the inconvenience of carrying the caddie in addition to the flight bag and having to securely attach the bag to the caddie each time the user desires to roll the bag. This inconvenience frequently outweighs the benefits associated with using the caddie.

In those flight bags in which wheels and pull handles have been integrated, the wheels were placed at a corner of the bag where a side wall and a bottom end wall of the bag meet, along the height dimension of the bag. A retractable pull handle is telescopically positioned within the interior of the bag. The pull handle and the guiding mechanism in which it moves extend across the side wall, and the pull handle emerges from the top end wall opposite the bottom end wall where the wheels are attached. The pull handle and guiding mechanism form a rigid structure which is necessary to support the weight of the luggage within the flight bag when it is wheeled. In the wheeled position the weight of the luggage in the flight bag must be supported on the side wall of the bag, and because the side wall is flexible, considerable sagging and distortion of the flight bag could result if the pull handle and guiding mechanism was not used to support this weight. The pull handle and guiding mechanism also has the effect of reducing the flexibility of the flight bag, because this rigid assembly extends across and thereby reduces the flexibility of the side wall.

It is with regard to this background information that the improvements available from the present invention have evolved.

SUMMARY OF THE INVENTION

In accordance with one of its significant aspects, the present invention relates to improvements in wheeled luggage bags preferably of the soft-sided, carry-on, flight-bag variety, in which a pair of wheels and a pull handle are integrated into the bag. The bag is of a substantially rectangular prismatic configuration having top, bottom, end and side walls extending in a length, width and height dimension. The wheels are connected at a corner location of the bottom wall and bottom end wall of the bag, and a pull handle comprising an elongated rod extends from and retracts into the bag, in a path generally parallel to and at the bottom wall of the bag. Preferably, the wheels are connected to an internal support structure and are spaced apart in the width dimension which is the shortest dimension of the prismatic configuration. The rod is also preferably movably connected to the internal support structure to telescope to the extended and retracted positions. The internal support structure preferably extends peripherally around the bag in the width dimension and the connection of the wheels and pull handle to the internal support structure does not diminish or reduce the flexibility of the soft-sided carry-on bag.

In accordance with another one of its aspects, the wheels have an exterior rolling surface of a predetermined shape which defines an edge at the outermost location of the two spaced apart wheels. The edges effectively increase the space between the wheels for supporting the bag and therefore achieve greater lateral stability. Preferably, the exterior surface of the wheels is frustoconically shaped, and the frustoconical surfaces converge toward one another to present the edge at the greatest separation in the width dimension. The increase in lateral stability obtained by the exterior surface of the wheels enhances the lateral stability of the bag when towed. Lateral stability when towing the bag is important because the wheels are spaced along the shortest width dimension of the bag, thereby providing less inherent stability than those prior art bags which position the wheels along a different greater dimension of the bag.

In accordance with another of its aspects, the pull handle is effective in transmitting torque between a grip which the user holds to tow the bag on its wheels, and the internal frame structure of the bag. The more effective torque transmission allows the user to maneuver the bag with a higher degree of control and to resist lateral forces caused by rolling the bag over uneven surfaces or going around corners. The torque transmission capability is achieved by forming channels in a structural member such as a bottom pan of the internal structure of the bag. A rod of the pull handle longitudinally moves within a slot formed by the channel, and a slider member is connected to the rod to allow sliding movement of the slider member along the slot while effectively transmitting torque between the rod and the structural member. Preferably the slot is rectangular or square shaped, and the slider has a corresponding and slightly smaller cross-sectional size. A guide member is preferably located at the upper end of the channel through which the rod extends, for the purpose of guiding the rod during extended and retracted movement. A resilient member of the guide member induces lateral frictional resistance on the rod to create sliding resistance and to allow the rod to stay in the position in which it is placed.

A more complete appreciation of the present invention and its scope can be obtained from understanding the accompanying drawings, which are briefly summarized below, the following detailed description of a presently preferred embodiment of the invention, and the appended claims.

DETAILED DESCRIPTION OF PREFERRED EMBODIMENT

Figure 1:
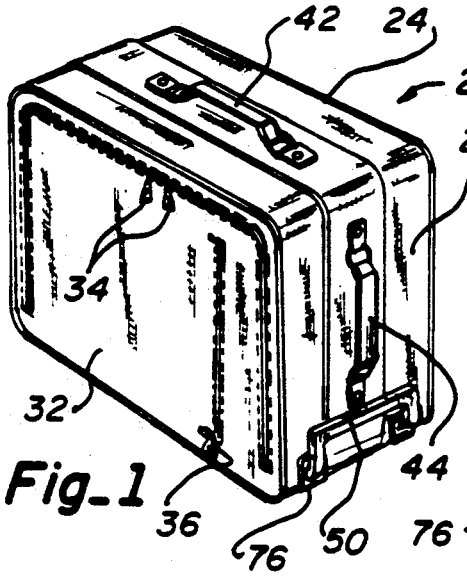
FIG. 1 is a perspective view of a flight bag in which the present invention is embodied, shown as it would normally rest after a user who had been carrying the case had set it down on a bottom wall of the bag.
Figure 2:
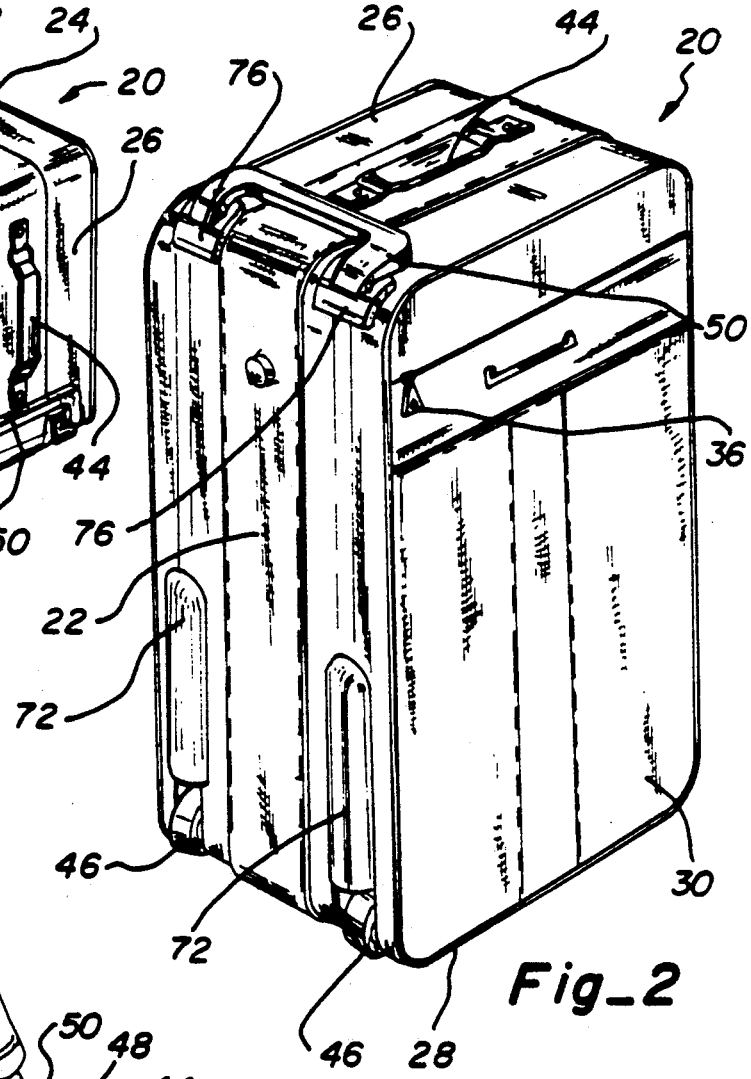
FIG. 2 is a perspective view of the flight bag shown in FIG. 1, shown as it would normally rest after a user who had been pulling the case along a support surface had set it down on a bottom end wall of the bag.
Figure 3:
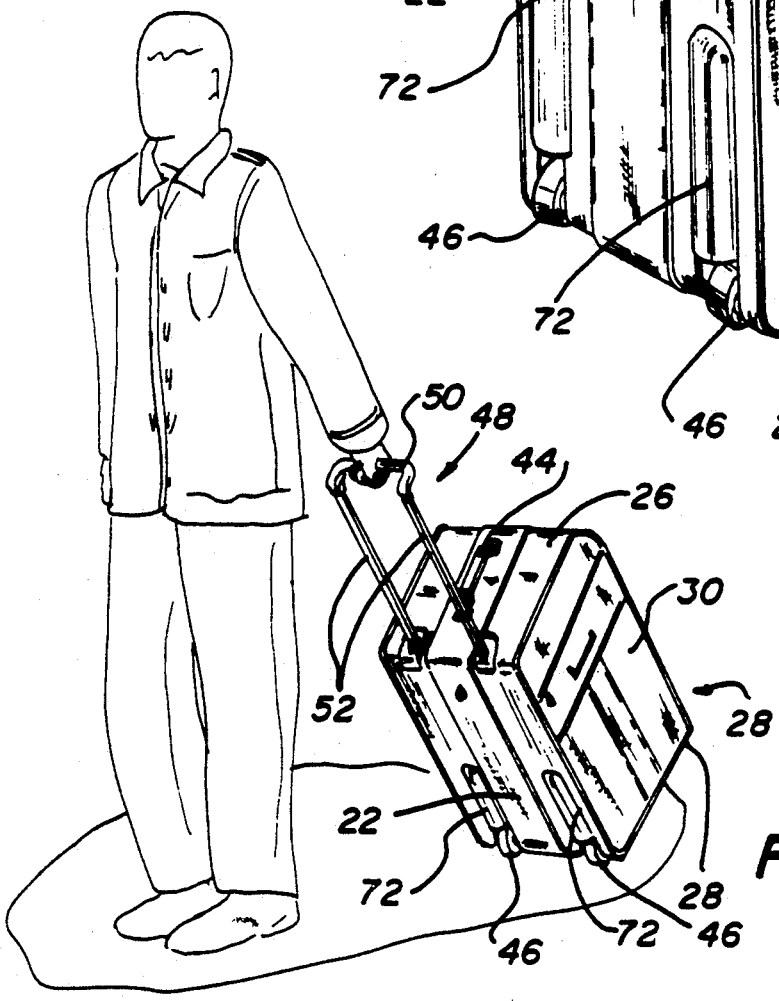
FIG. 3 is a perspective view of the flight bag shown in FIGS. 1 and 2, shown with the pull handle in an extended position and being towed on its wheels by a traveler.

The improvements of the present invention are described in conjunction with a flight bag 20 shown in FIGS. 1, 2 and 3, although the present invention may be utilized with a wide variety of luggage cases and bags of different configurations. The flight bag 20 has a generally rectangular prismatic configuration formed by opposing wall structures. The wall structures include a bottom wall 22, a top wall 24, a top end wall 26, a bottom end wall 28, and a left side wall 30 and a right side wall 32, all of which are connected together along their edges to form a hollow interior enclosure for luggage. Access to the interior of the case 20 is obtained through zippers 34 formed in the right side wall 32. The side walls 30 and 32 also include zippers 36 to provide entry into pockets formed in the side walls 30 and 32.

The substantially rectangular prismatic configuration has a length dimension which extends in the direction of the flight bag 20 between the top end wall 26 and the bottom end wall 28. The length dimension is the longest of the three dimensions of the flight bag 20. The height dimension extends in the direction of the flight bag 20 between the top wall 24 and the bottom wall 22. The width dimension extends in the direction of the flight bag 20 between the two side walls 30 and 32. The width dimension is the shortest of the three dimensions of the flight bag 20.

The walls 22, 24, 26, 28, 30 and 32 are preferably formed of flexible material, such as cloth, leather or vinyl, thereby making the flight bag 20 a "soft sided" luggage case. However, the present invention may be applied to hard sided luggage cases, in which the walls of the luggage case are formed from more rigid materials, such as plastic.

Figure 4:
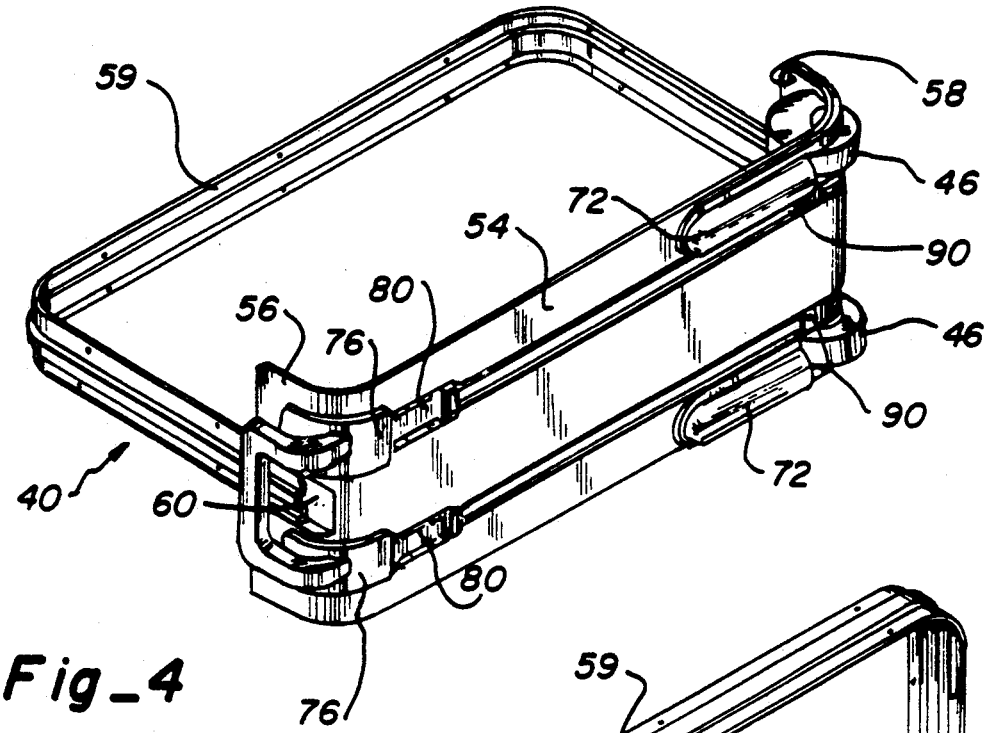
FIG. 4 is a perspective view of an internal support structure of the flight bag shown in FIGS. 1, 2 and 3, shown removed from the flight bag.
Figure 5:
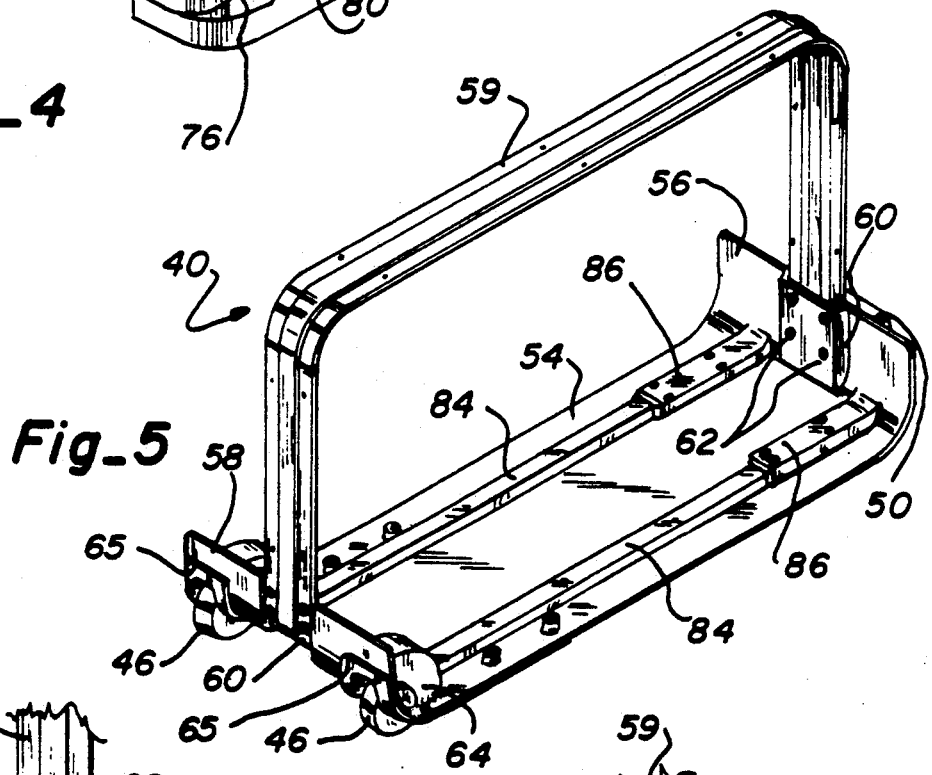
FIG. 5 is a perspective view of the internal support structure shown in FIG. 4.

Since the flight bag 20 is of the soft sided construction, it is necessary to provide an internal support structure for the flexible walls to give the bag shape and weight carrying capability. An internal support structure 40 is illustrated in FIGS. 4 and 5. The internal support structure is peripherally surrounded by the bottom, top and end walls 22, 24, 26 and 28, respectively, and accordingly, the internal support structure 40 is generally rectangular. The use of an internal support structure for a soft sided luggage bag is conventional, as is the techniques by which the walls 22, 24, 26 and 28 are attached to or integrated with the support structure.

Handles 42 and 44, shown in FIGS. 1 and 2, extend from the top wall 24 and top end wall 26, respectively, and are connected through the walls to the internal support structure 40 to allow the flight bag 20 to be carried in either of two orientations. In the most typical orientation, a user grips the handle 42 on the top wall 24 to carry the flight bag 20 with the length dimension horizontal, as is shown in FIG. 1. In the other orientation, the handle 44 on the top end wall 26 is gripped to carry or position the flight bag 20 with its length dimension oriented vertically as is shown in FIG. 2.

In addition to carrying the flight bag 20, it may be rolled on a pair of wheels 46 which are positioned at the junction of the bottom wall 22 and the bottom end wall 28 and laterally near the side walls 30 and 32. As is shown in FIGS. 4 and 5, the wheels 46 are connected to the internal support structure 40 to achieve the preferable degree of connection integrity with the bag 20 to guide and support the bag while the bag is pulled on the wheels as is shown in FIG. 3. The placement of the wheels 46 along the width dimension also allows the flight bag 20 to present its narrowest profile when towed by a user. Towing the bag in the direction of its narrowest profile enhances the convenience of towing the flight bag 20 through crowded or confined areas where the flight bag 20 would not otherwise fit if the wheels 46 had spanned either the length or height dimensions.

Figures 15, 16, 17, 18:
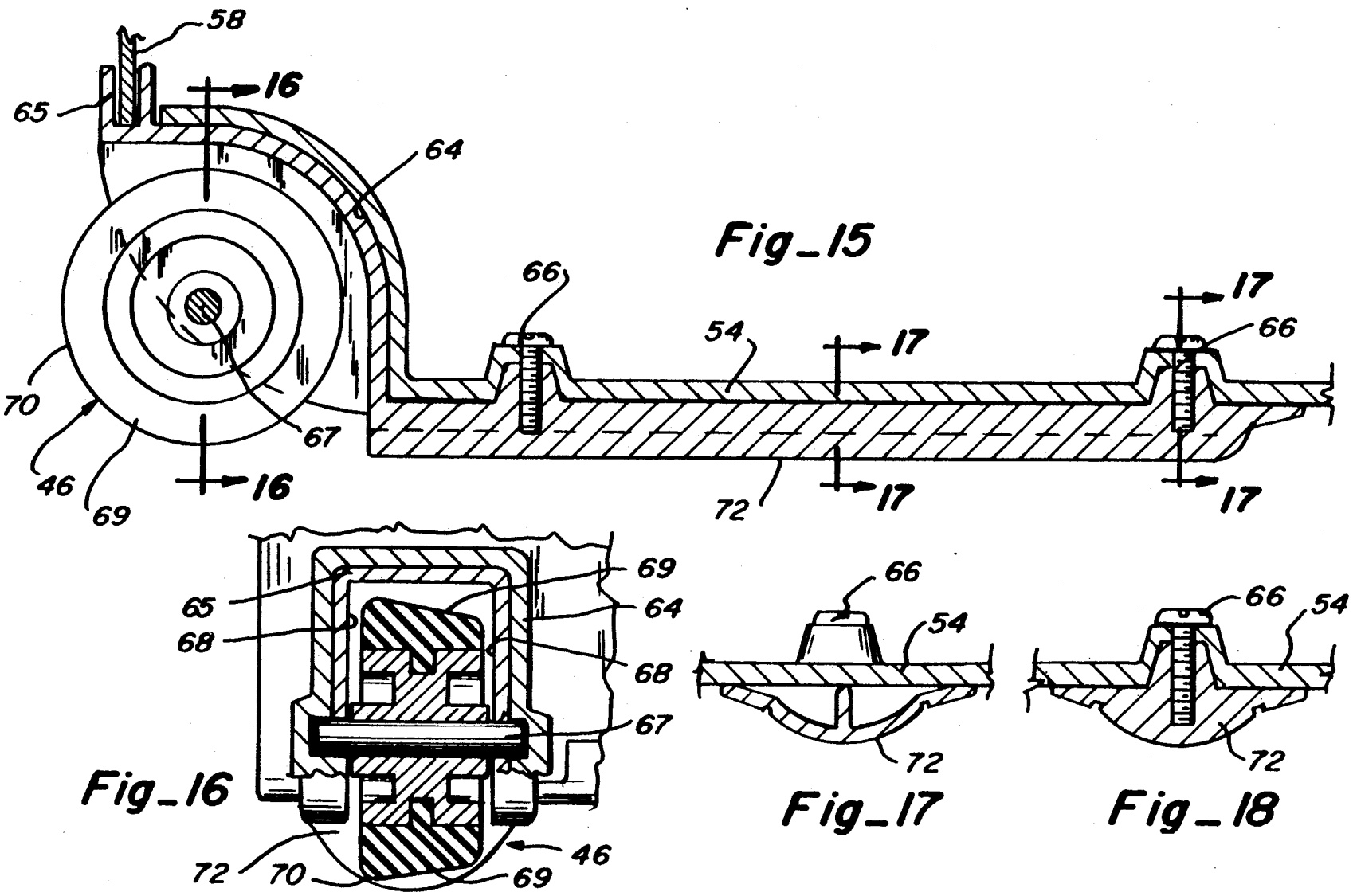
FIG. 15 is an enlarged section view taken substantially in the plane of line 15—15 of FIG. 8.
FIG. 16 is a section view taken substantially in the plane of line 16—16 of FIG. 15.
FIG. 17 is a section view taken substantially in the plane of line 17—17 of FIG. 15.
FIG. 18 is a section view taken substantially in the plane of line 18—18 of FIG. 15.

A maximum amount of distance in the width dimension separates the wheels 46 to provide maximum lateral stability when towing. A substantial majority of both wheels 46 is recessed within the exterior of the internal structure 40, thereby exposing only a limited portion of the wheels at the corner, as is best shown in FIG. 15. The wheels 46 are positioned in such a manner that, upon tilting the flight bag 20 so that neither the bottom end wall 28 or the bottom wall 22 contacts the supporting surface and both walls 22 and 28 are at an acute angle to the support surface (FIG. 3), the exposed exterior surface of the wheels 46 contacts the support surface. Thus, the degree of exposure of the wheels 46 and their location at the corner causes the wheels to contact the support surface and support the flight bag 20 so that it may be rolled on the wheels 46, as is shown in FIG. 3.

A pull handle 48 is used to tow the flight bag 20 and to control the movement of the flight bag when it is rolled on the wheels 46, as is shown in FIG. 3. The pull handle 48 includes a grip 50 connected to a pair of parallel rods 52. These rods 52 are preferably made from a stiff resilient material. The stiffness should resist both lateral bending as well as twisting forces. Fiberglass reinforced pultruded rods are preferred. The rods 52 telescopically extend from and retract into the flight bag 20 at the top end wall 26. Extension of the rods 52 positions the grip 50 a sufficient distance from the top end wall 26 to allow a user to conveniently tow the flight bag 20 at an angle which allows the exposed portion of the wheels 46 to support the flight bag, as is shown in FIG. 3. Of course, when the flight bag is not being towed and the pull handle 48 is not needed, the rods 52 are retracted within the interior of the flight bag 20. In the retracted position the grip 50 occupies a position adjacent to the top end wall 26 and is only minimally exposed, as is shown in FIGS. 1 and 2, thus ensuring the pull handle 48 will not be damaged during normal handling of the flight bag 20. The rods 52 are connected to the internal support structure 40 to allow them to telescope between the extended and retracted position and to transfer torsional forces between the grip 50 and the support structure 40 and the wheels 46 to maneuver the flight bag 20 when it is towed and to resist lateral forces which might topple the bag when it is towed.

Figure 6:
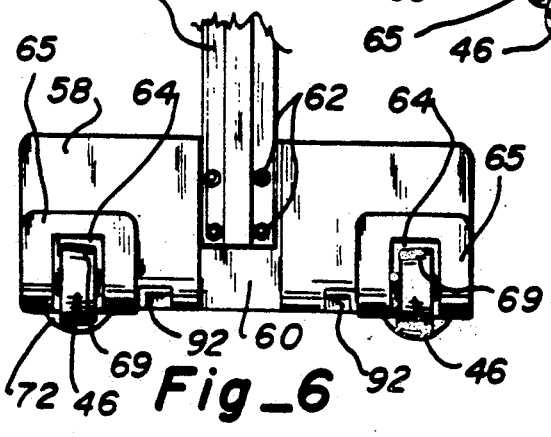
FIG. 6 is an enlarged partial elevational view of the support structure shown in FIG. 5, viewed from a bottom end wall of the bag.
Figure 7:
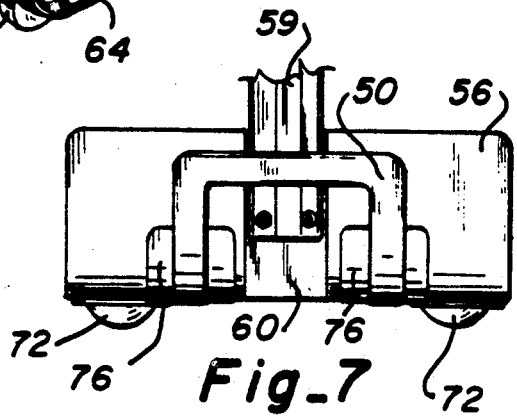
FIG. 7 is an enlarged partial elevational view of the support structure shown in FIG. 5, viewed from a top end wall of the bag.
Figure 12:
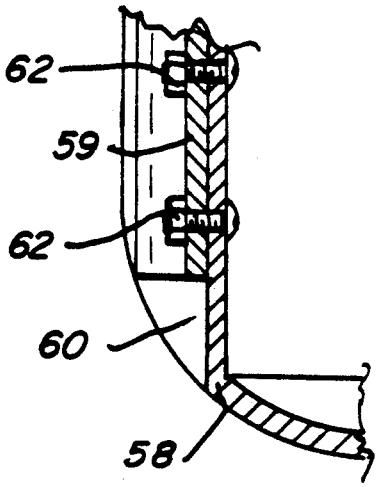
FIG. 12 is an enlarged section view taken substantially in the plane of line 12—12 of FIG. 8.

The support structure 40 shown in FIGS. 4 and 5 includes a bottom pan 54 which extends substantially the full length and width of the bottom wall of the flight bag. A top curved corner 56 and a bottom curved corner 58 of the bottom pan 54 curve upward into the planes of the top end wall 26 and bottom end wall 28, respectively. A U-shaped frame 59 is attached to the bottom pan 54 at recesses 60 formed within the curved ends 56 and 58, by fasteners such as screws or rivets 62 as shown in FIGS. 6 and 12. The U-shaped frame 59 extends above the bottom pan 54 to complete the support structure 40 in a generally rectangular peripheral configuration in the width dimension. The U-shaped frame 59 contacts and is connected to the top end wall 26, the bottom end wall 28 and the top wall 24 in a conventional manner typical to soft sided luggage.

The handles 42 and 44 (FIGS. 1 and 2) are connected to the U-shaped frame member 59 to support the weight of the flight bag 20, and the luggage contained therein. The bottom pan 54 extends substantially the full length and width of the bottom wall 22 in order to provide support for the weight of the luggage over the full length and width of the flight bag 20 when the bag 20 is carried in the typical position with the length dimension horizontal as shown in FIG. 1. In addition, the dimensions of the bottom pan 54 provide substantial support for the weight of the luggage in the bag when the bag is towed. The fact that the bottom pan is in the lowermost position to support the weight of the luggage is a substantial improvement of the present invention compared to the prior art which orients one of the bag side walls downward. In the prior art configuration, the weight of the luggage must be supported by a flexible side wall and by a mechanism for positioning the telescoping rods of the pull handle.

The wheels 46 are each positioned in a recess 64 formed in the bottom curved corner 58 of the bottom pan 54, as is shown in FIGS. 5, 6, 7, 15 and 16. An insert assembly 65 is attached to the bottom pan 54 by fasteners 66 (FIG. 15), and the insert assembly 65 operatively attaches the wheels to the bottom pan 54. Each of the wheels 46 includes an axle 67 which extends in the width dimension between holes in the side walls 68 of the insert assembly 65 which receive the ends of the axles 67. With the insert assemblies 65 connected to the bottom pan 54, the axles 67 and wheels 46 are retained in position within the recesses 64 and allow the wheels 46 to rotate in a plane which extends in the length and height dimensions of the flight bag 20 and parallel to the path in which the flight bag is towed.

Each of the wheels 46 has an exterior frustoconical shaped surface 69 which tapers in a converging manner toward the opposite wheel 46, as shown in FIGS. 6 and 16. The purpose of the frustoconical shaped surface 69 of each wheel 46 is to provide the widest tracking distance in the width dimension between the wheels 46. This tracking distance is greater than would otherwise be provided if the exterior surface of each wheel 46 was of a typical cylindrical or rounded shape. An outermost edge 70 (FIG. 16) of each of the wheels 46 provides the maximum width of the track to offer greater resistance to sideways tipping of the bag when it is rolled on its wheels 46.

A skid 72 is attached to the bottom pan 54 longitudinally ahead of each of the wheels 46, as is shown in FIGS. 2–4, 6–8 and 15–18. The skid 72 is preferably an integral part of the insert assembly 65. Each skid 72 protrudes downwardly from the bottom pan 54 below the exterior surface 69 of each wheel 46, as is shown in FIGS. 15 and 16. Therefore, when the flight bag 20 is positioned on a support surface with the longitudinal dimension horizontal, as shown in FIGS. 1 and 15, the bag 20 rests on the skids 72. As a result, the wheels 46 are ineffective in allowing the flight bag 20 to roll in this situation. Another function of the skids 72 is shielding the wheels 46 when the flight bag 20 is pulled over corners such as street curbs or the edges of stairs. Such protection is important in helping to shield the wheels 46 from potentially destructive collisions. The skids 72 also shield the wheels 46 from potentially damaging contact during rough handling of the flight bag 20.

Figure 10:
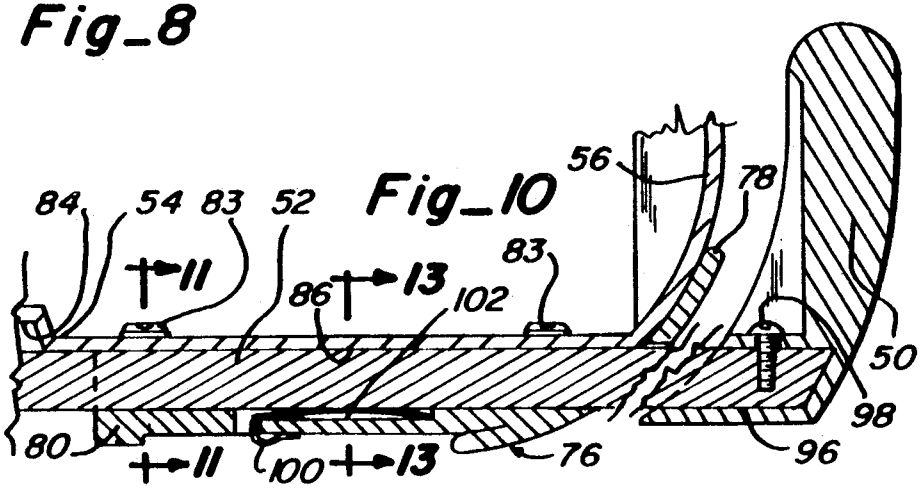
FIG. 10 is an enlarged section view taken substantially in the plane of line 10—10 of FIG. 8.
Figure 11:
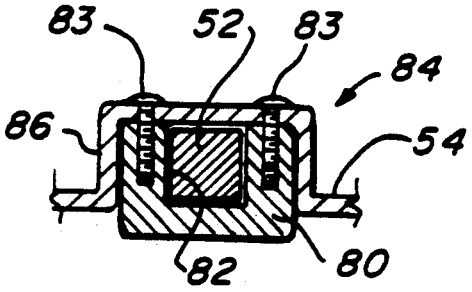
FIG. 11 is an enlarged section view taken substantially in the plane of line 11—11 of FIG. 10.
Figure 13:
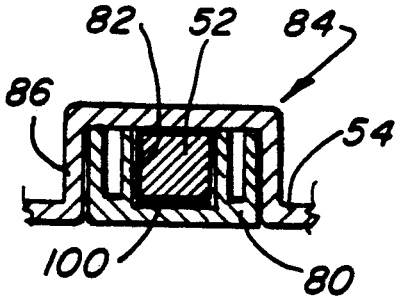
FIG. 13 is a section view taken substantially in the plane of line 13—13 of FIG. 10.

A guide 76 surrounds a segment of each of the rods 52 at the top curved corner 56 of the bottom pan 54, as shown in FIGS. 1–4, 7, 8 and 10. As is best shown in FIG. 10, each guide 76 includes an outer flange 78 which has a curved inner shape which conforms with, contacts and generally seats against the outer curved configuration of the curved end 56. A sleeve 8 extends longitudinally through the curved end 56. The sleeve 80 generally defines a U-shaped channel 82 as is shown in FIGS. 11 and 13 within which the rods 52 are received. The square rod 52 is guided by the U-shaped channel 82 of the sleeve 80. The guide 76 positions the sleeve 80 generally in alignment with the bottom pan 54 at the curved corner 56 and the guide is held in position by fasteners 83 (FIGS. 10 and 11). The sleeve 80 holds the rods 52 in position on the bottom pan 54 to achieve the functionality associated with the rods.

A pair of U-shaped channels 84 are formed in the bottom pan 54, as is shown in FIGS. 5, 8 to 10, 11, 13 and 14. One rod 52 is received within each of the channels 84. Each channel positions the rod 52 for the telescoping movement between the extended and retracted positions. Each channel 84 has an enlarged portion 86 (FIGS. 5, 8, 10, 11 and 13) adjacent to the curved corner 56 which forms a receptacle for the sleeve 80 of each guide 76. The sleeve 80 of each guide 76 is retained within the enlarged portion 86 by fasteners 83 shown in FIGS. 10 and 11. The contact of the flange 78 with the exterior surface of the curved end 56 also helps to hold each guide 76 in position. The channels 84 are preferably formed integrally with the bottom pan 54. The channels 84 increase the reinforcement of the bottom pan 54 to withstand the weight of luggage which might otherwise cause failure or an unacceptable degree of sagging.

As is shown in FIGS. 8, 9, 11, 13 and 14, each channel 84 is generally of a rectangular U-shaped configuration in the bottom pan 54 with an interior square U-shaped slot 88 facing downward in the height dimension. The U-shaped slot 88 is larger in both the height and width dimensions than the cross section of the square rods 52. Such dimensions eliminate contact between the rods 52 and the walls of the channel 84 to prevent friction from movement of the rods 52 when extending or retracting the pull handle 48. The rods 52 are exposed in the open U-shaped slots 88, but when the material forming the bottom wall 22 is attached on the exterior of the bottom pan 54, the rods 52 and the sleeve portion 80 of the guide 76 are concealed from view. The material of the bottom wall 22 also prevents dirt and other foreign articles from entering the slot 88 and interfering with the movement of the rods 52 upon extension or retraction of the pull handle 48.

Figure 8:
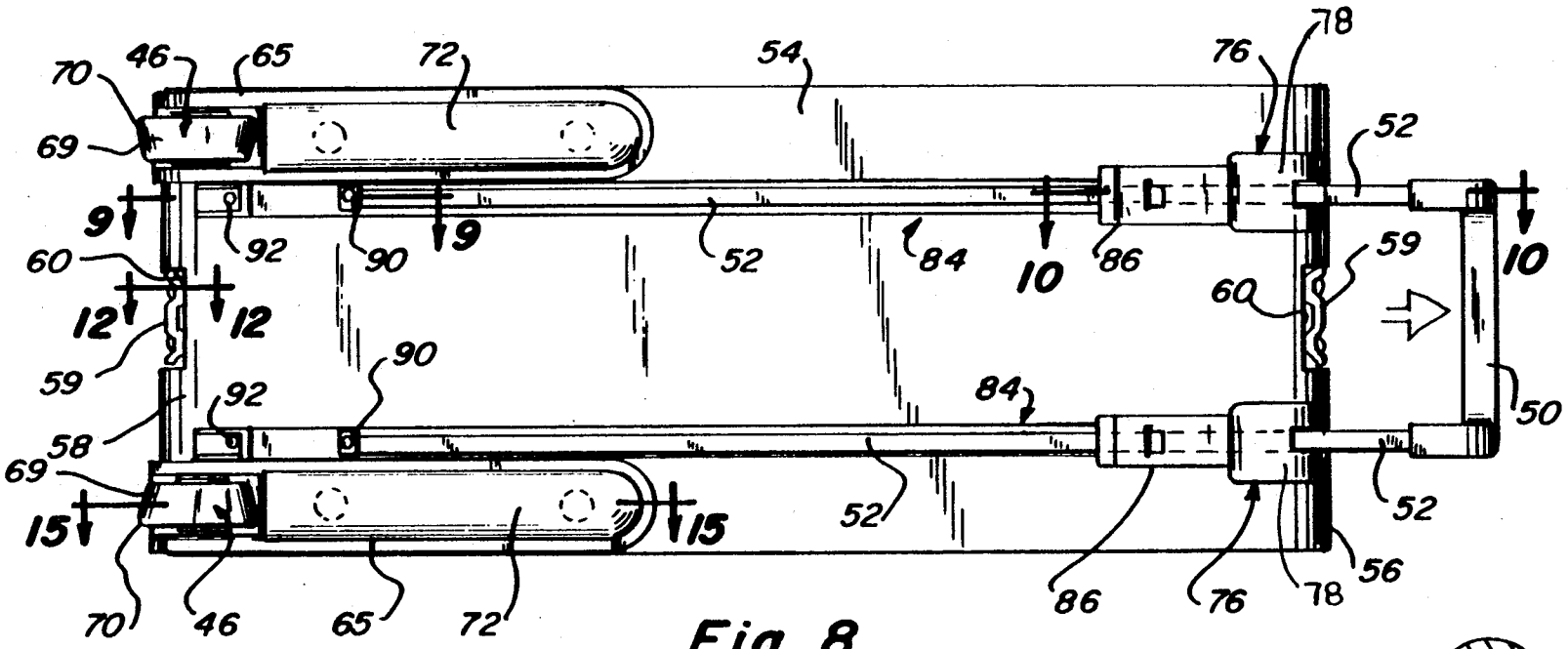
FIG. 8 is a bottom plan view of the internal support structure shown in FIGS. 4 and 5, illustrating a bottom pan, wheels and a pull handle in a partially extended position.
Figure 9:
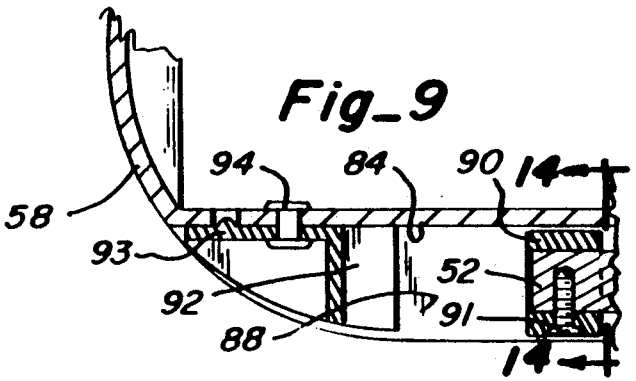
FIG. 9 is an enlarged section view taken substantially in the plane of line 9—9 of FIG. 8.
Figure 14:
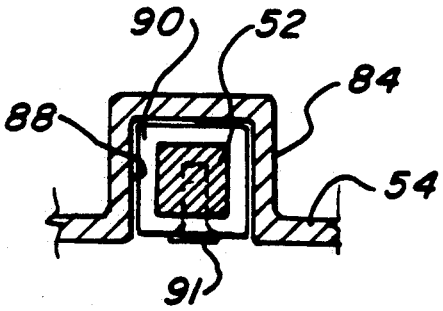
FIG. 14 is a section view taken substantially in the plane of line 14—14 of FIG. 9.

A slider member 90 is securely attached by a fastener 91 to the end of each rod 52 which is opposite the end of the rod 52 attached to the grip 50, as is shown in FIGS. 8, 9 and 14. The slider member has a prismatic sectional shape, in particular a parallelopiped shape, which corresponds to the cross sectional shape of its receiving slot 88. The size of the slider 90 in the height and width dimensions is therefore slightly less than the height and width dimensions of the slot 88. Each slider 90 is therefore able to both contact the side walls of the slot 88 and move relatively freely along the slot 88 when the rods 52 are telescopically extended or retracted.

When the pull handle 48 is in a fully retracted position, each slider 90 contacts a resilient bumper member 92 positioned in the slot 88 at the end of the channel 84 adjacent to the curved corner 58, as is shown in FIG. 9. Each bumper 92 is attached to the bottom pan 54 by a bracket 93 and a fastener 94. The bumpers 92, rather than the guides 76 or the grip 50, limit the maximum inward extent of movement of the rods 52 when the pull handle 48 is fully retracted within the flight bag 20. When the pull handle 48 is fully extended, the sliders 9 contact the inner ends of the sleeves 80 of the guides 76 to limit further extension of the pull handle 48, as is shown in FIGS. 8 and 10.

The ends of the rods 52 opposite of the ends at which the sliders 90 are connected, are received in correspondingly shaped receptacles 96 in the grip 50, as shown in FIG. 10. Pins 98 or other suitable fasteners connect the grip to the end of the rods 52. The rods 52 are of a configuration which is effective in transmitting torque through them. The square cross sectional configuration of the rods 52 is effective in this regard.

On of the important functions of the slider 90 is to transmit torsional forces applied through the rods 52 between the grip 50 and the support structure 40 of the flight bag 20. A capability to transmit torsional force from the grip 50 to the support structure 40, or to resist torsional force from the support structure 40 to the grip 50, counteracts any tendency of the flight bag 20 to topple over while being towed by the user. If the flight bag 20 experiences a torque caused by an uneven support surface over which the bag 20 is towed, or by the effect of negotiating the flight bag 20 through a turn, or by a sudden change in momentum while towing the bag 20, the sliders 90 effectively transmit the torque to and from the rods 52. The user may then provide a countertorque on the grip 50 through the rods 52 to stabilize the flight bag 20 and prevent its toppling over. The torsional force transferring capability is also useful in achieving a more effective degree of control over the direction of movement of the flight bag 20 when it is towed.

With the wheels 46 positioned along the narrowest width dimension of the flight bag 20, there is both an increase in maneuverability and an increase in potential for toppling sideways due to uneven support surfaces over which the flight bag 20 is rolled. Rather than achieve an increase in lateral stability by placing the wheels along the wider height dimension a has been done in a prior art flight bag, compensation is achieved through the use of the torsional transmission capability of the rods 52 and sliders 90. Additional stability is achieved by using a frustoconical surface 69 on the wheels 46 as has been described above.

Effective torque transmission capability is also very desirable due to the weight of the luggage in the bag 20 being above the bottom pan 54 and the rods 52 when the bag is towed as is shown in FIG. 3. In this orientation, the tendency for lateral instability is related to the center of gravity point of the luggage within the bag 20 relative to the wheels 46. The tendency to resist toppling is related to the point at which the torsional forces from the rods 52 are applied relative to the wheels 46. Since the distance from the center of gravity to the wheels 46 is greater than the distance from the application of torsional force from the rods 52 to the wheels 46, a greater torsional force must be transmitted through the rods to the support structure 40 to resist the more moderate forces applicable on the luggage in the bag. The torque transmission requirements of the present invention, due to the lower location of the rods 52, are considerably more important than the requirements of those prior art luggage cases which have the rods of the pull handle extend from the top of the luggage enclosure, thereby suspending the luggage below the extendable rods. In this prior art situation, the opposite situation occurs. The distance from the center of gravity to the wheels is much less than the distance from the extendable rods to the wheels, thereby reducing the requirements for torque transmission through the rods.

To create moderate resistance to the uncontrolled telescoping movement of the rods 52, a resilient spring 100 is located within a recess 102 in inner walls of each sleeve 80, as shown in FIG. 10. The resilient springs 100 press outwardly against a flat surface of the rods 52, thereby creating a moderate amount of friction to resist the undesired movement of the pull handle 48. As a result, the pull handle 48 may be variably extended to any degree required for the convenience of the user. In this manner users of different heights may extend the pull handle 48 to a length at which they are comfortable rather than having to conform to the full length of the pull handle 48. While some prior art luggage flight bags use detents within the extendable rods to provide for variable extension of the handle, such a solution in undesirable due to the limited number of detents allowed and the stress concentrations which accompany both the deformation of the rods and the repeated loading at these exact same points on the rods. The resilient springs 100 do not deform the rods 52 and provide resistance force over the full range of extension of the pull handle 48. Additionally, the springs 100 ensure that the pull handle 48 will stay in the retracted position when not in use.

When the flight bag 20 is being towed and the pull handle 48 is extended, a user may transport auxiliary articles of luggage by placing them on the top end wall 26 of the flight bag 20 and allowing them to rest against the extended rods 52 once the flight bag 20 is tilted as shown in FIG. 3. This technique of carrying auxiliary articles is somewhat related to a technique of carrying auxiliary articles described in U.S. Pat. No. 4,759,431 assigned to the assignee of the present application. However, in a typical carrying situation described in the above patent, maximum stability is usually desired which is achieved by locating the wheels along the longest or length dimension of the case. Since the wheels 46 are located along the shortest or width dimension of the bag 20 in the present invention, it is important to achieve very effective transmission capability between the grip 50 and the internal structure 40 to obtain good control over the lateral influences on the bag 20.

The flight bag 20 does not include any means which might retain the auxiliary articles of luggage and prevent their falling off the flight bag 20. However, the spring 100 allows the user to extend the pull handle 48 to only the extent required to fit the auxiliary articles between the top end wall 26 and the grip 50 so that the user may grasp both the grip 50 and the auxiliary articles simultaneously to prevent their slipping off of the flight bag 20.

Thus, the placement of the pull handle 48 along the bottom wall of the luggage flight bag 20 creates a more sturdy bottom pan 54 and increases the convenience of the flight bag 20 since users may piggyback other articles of luggage when they tow the flight bag 20. Additionally, users may choose the degree of extension they desire from the pull handle 48 due to the resilient springs 100 within the sleeves 80 of the guides 76. Although the placement of the wheels 46 along the narrow width dimension of the flight bag 20 increased the flight bag's maneuverability at the cost of some of its lateral stability, the frustoconical surfaces 69 of the wheels 46 and the snug fit of the sliders 90 within the channels 84 compensate for the lost stability and allow the user to more easily control the flight bag 20 during towing.

A presently preferred embodiment of the present invention and many of its improvements have been described with a degree of particularity. This description has been made by way of preferred example. It should be understood, however, that the scope of the present invention is defined by following claims, and not necessarily by the detailed description of the preferred embodiment.

The invention claimed is:

1. A wheeled luggage bag of a generally rectangular prismatic configuration formed by a bottom wall and a top wall opposing one another and both extending in a length and a width dimension of the prismatic configuration, a top end wall and a bottom end wall opposing one another and both extending in a height and the width dimension of the prismatic configuration, and a right side wall and a left side wall opposing one another and both extending in the length and height dimensions of the prismatic configuration, the length dimension being the greatest dimension and the width dimension being the least dimension, the walls connecting together at their intersections to form the prismatic configuration with an interior enclosure adapted for receiving luggage, and an improvement in combination therewith comprising:

a pair of wheels located at the intersection of the bottom wall and the bottom end wall, the wheels spaced apart from one another in the width dimension, the wheels rotating in a plane substantially defined by the length and height dimensions;

a pull handle connected to the bag at the bottom wall and including a grip and at least one elongated rod, the elongated rod located at the bottom wall and extendable away from and retractable toward the top end wall, the grip connected to an end of the rod which is extendable together with the rod away from the end wall, the rod connected to the bag to transmit torsional forces through the rod between the bag and the grip;

an internal support structure extending along the bottom wall and supporting the bottom wall and wherein the wheels are rotatably connected to the support structure at approximately the location of the connection of the bottom wall and the bottom end wall, and the rod is slidably connected to the internal support structure.

2. A wheeled luggage bag as defined in claim 1, wherein the internal support structure comprises:

a bottom pan which extends substantially over the full width and length dimensions of the bottom wall, and a U-shaped frame member connected to the bottom pan and extending along the top and bottom end walls and the top wall.

3. A wheeled luggage bag as defined in claim 2 wherein:

the bottom pan includes recesses located at a bottom corner of the bottom pan where the bottom wall and the bottom end wall connect, and the wheels are rotatably connected within the recesses.

4. A wheeled luggage bag as defined in claim 3 wherein:

the bottom corner of the bottom pan curves from the bottom wall into the bottom end wall; and an exterior surface of the wheels extends from the recesses at the bottom curved corner by a predetermined amount.

5. A wheeled luggage bag as defined in claim 4 wherein:

a top corner of the bottom pan where the bottom wall and the top end wall connect curves from the bottom wall into the top end wall; and wherein:

the rod extends through the top curved corner.

6. A wheeled luggage bag as defined in claim 5 further comprising:

a guide member positioned in the top curved corner and surrounding the rod to guide the rod during extending and retracting movement.

7. A wheeled luggage bag as defined in claim 6 wherein the guide member further comprises:

a flange adjoining the top curved corner, and a sleeve which extends from the flange through the top curved corner and along the bottom pan.

8. A wheeled luggage bag as defined in claim 7 wherein the guide member further comprises:

a resilient member connected to the sleeve and engaging the rod to induce lateral frictional resistance to the movement of the rod.

9. A wheeled luggage bag as defined in claim 8 wherein the bottom pan further comprises:

a channel extending from the top curved corner along the length dimension toward the bottom curved corner, and wherein:

the channel defines a slot within which the rod is received and moves; and the slot includes an enlarged portion adjacent the top curved corner for receiving the sleeve of the guide.

10. A wheeled luggage bag as defined in claim 9 wherein:

the channel is generally U-shaped and the slot is generally rectangular in cross section;

the rod is generally rectangular in cross section; and the cross sectional size of the rod is smaller than the cross sectional size of the slot to create spaces between the rod and the channel in the slot.

11. A wheeled luggage bag as defined in claim 10 further comprising:

a slider member connected to an end of the rod moving within the channel, the slider member contacting the channel in the slot to transmit torque from the rod to the bottom pan; and a bumper member positioned in the slot at a location adjacent the bottom curved corner to contact the slider member and limit the maximum amount of retracted movement of the rod; and wherein:

the sleeve is positioned in the slot at a location adjacent the top curved corner to contact the slider member and limit the maximum amount of extended movement of the rod.

12. A wheeled luggage bag as defined in claim 11 wherein the pull handle further comprises:

a second rod substantially similar to the rod, the rod and the second rod forming a pair of rods, the pair of rods are spaced apart from one another and extending generally parallel to one another when extended from the top end wall, a second guide member surrounding the second rod at a location where each rod extends through the top curved corner, a second channel formed in the bottom pan for the second rod, and a second slider member connected to an end of the second rod; and the grip comprising a grip member attached to and extending between the pair of rods at ends thereof opposite from the sliders.

13. A wheeled luggage bag as defined in claim 11 wherein:

the wheels have an exterior surface upon which the wheels roll, and the wheels are spaced apart a predetermined maximum distance in the width dimension to position an outside surface of the wheels at substantially the full width dimension and between geometric planes located along the right and left side walls in the length and height dimensions.

14. A wheeled luggage bag as defined in claim 13 wherein:

the exterior surface of each wheel has a predetermined frustoconical shape, and the exterior frustoconical surfaces of the spaced apart wheels converge toward one another.

15. A wheeled luggage bag as defined in claim 11 further comprising:

a skid member attached to the bottom pan at a position adjacent each wheel and spaced in the length dimension toward the top curved corner.

16. A wheeled luggage bag as defined in claim 11 wherein:

the bottom wall, and top wall, the bottom end wall, the top end wall, and the right and left side walls are formed of flexible material, and the bottom wall, the top wall, the bottom end wall and the top end wall are connected to and supported by the internal structural support.

17. A wheeled luggage bag as defined in claim 1 further comprising:

a bottom pan which extends substantially over the full width and length dimensions of the bottom wall, the bottom pan including a curved top corner at an intersection where the bottom wall curves into the top end wall and a curved bottom corner at the intersection where the bottom wall curves into the bottom end wall;

recesses in the bottom curved corner of the bottom pan;

means for rotatably mounting the wheels within the recesses and positioned whereby circumferential exterior surfaces of the wheels project from the recesses at the bottom curved corner by a predetermined amount to position the wheels to avoid contact of the exterior surfaces of the wheels with a support surface when the bag is resting on the bottom wall or on the bottom end wall and to position the wheels to contact the support surface when the bag is tilted with the bottom wall and the bottom end wall both at an acute angle to the support surface; and a channel extending from the top curved corner along the length dimension toward the bottom curved corner, the channel defining a slot within which the rod is received and moves.

18. A wheeled luggage bag as defined in claim 17 further comprising:

a guide member positioned in the top curved corner and surrounding the rod to guide the rod during extending and retracting movement, the guide member further comprising a flange adjoining the to curved corner, and a sleeve extending from the flange and back along the bottom pan.

19. A wheeled luggage bag as defined in claim 18 further comprising:

a resilient member connected to the sleeve and engaging the rod to induce lateral frictional resistance to the movement of the rod, and the slot includes an enlarged portion adjacent the top curved end for receiving the sleeve of the guide member.

20. In a wheeled luggage bag of a generally rectangular prismatic configuration with an interior enclosure adapted for receiving luggage, comprising a pair of wheels spaced apart from one another and attached to the prismatic configuration for supporting the bag when moved on the wheels, a pull handle extending from the bag for towing the bag on the wheels upon a support surface, the wheels rotating in a plane extending substantially parallel to the movement of the bag when towed, an improvement in combination therewith comprising:

an exterior surface of one of said pair of wheels having a predetermined shape defining a circular edge having a circumference greater than the remainder of the exterior surface, the edge is positioned at an outermost location from the other wheel of said pair of wheels and which contacts the support surface upon which the bag is towed to the substantial exclusion of the remainder of the exterior surface.

21. A wheeled luggage bag as defined in claim 20 wherein the exterior surface of said wheel is frustoconical shaped, and the edge is the portion of the exterior which has the greatest circumference.

22. A wheeled luggage bag as defined in claim 21 wherein the exterior surface of each wheel has a predetermined frustoconical shape, and the exterior frustoconical surfaces of the spaced apart wheels converge toward one another.

23. A wheeled luggage bag as defined in claim 20 wherein:

the wheels are attached in a spaced apart orientation adjacent to one corner of the prismatic configuration, the corner extending along one of the dimensions of the prismatic configuration; and the wheels are partially recessed within the interior enclosure of the prismatic configuration to extend the exterior surface of the wheels from the prismatic configuration a sufficient amount to only support the bag for movement when the bag is tilted with one corner at a lowermost position.

24. A wheeled luggage bag as defined in claim 20 wherein:

the wheels are spaced apart to substantially the distance of the dimension of the one corner of the prismatic configuration where the wheels are attached to position an outside surface of the wheels at substantially the full width of the dimension of the one corner.

25. A wheeled luggage bag as defined in claim 24 wherein the distance of the one dimension is the shortest dimension of the rectangular prismatic configuration.

26. In a wheeled luggage bag of a generally rectangular prismatic configuration with an interior enclosure adapted for receiving luggage, comprising a pair of wheels spaced apart from one another and attached to the prismatic configuration for supporting the bag when moved on the wheels, a pull handle extending from the bag at a location opposite the wheels for towing the bag substantially only on the pair of wheels, the wheels rotating in a plane extending substantially parallel to the movement of the bag when towed, the pull handle including a substantially rigid rod which is connected at one end to the bag and which is moveable between a retracted position in which the pull handle is not substantially extended from the bag and an extended position for towing the bag, the substantially rigid rod having a torque transferring capability along its length, an improvement in combination therewith comprising:

a structural member connected to the bag and having a channel extending therealong, the channel defining a slot having a predetermined configuration, the slot receiving the rod and accommodating the extended and retracted movement of the rod; and a slider member securely attached to the one end of the rod and having a prismatic cross sectional shape corresponding to the cross sectional shape of the slot, the shape of the slider member allowing sliding movement of the slider member along the slot with the extended and retracted movement of the rod while transmitting torque between the rod and the structural member.

27. A wheeled luggage bag as defined in claim 26 wherein the slider member is rigidly connected to the one end of the rod.

28. A wheeled luggage bag as defined in claim 26 wherein:

the channel is generally U-shaped and the slot is generally rectangular in cross section;

the rod is generally rectangular in cross section; and the cross sectional size of the rod is smaller than the cross sectional size of the slot to create spaces between the rod and the channel in the slot.

29. A wheeled luggage bag as defined in claim 28 wherein:

the cross sectional configuration of the rod and the slot are square; and the slider member extends outward from the rod to position the rod out of contact with the channel.

30. A wheeled luggage bag as defined in claim 29 further comprising:

a guide member positioned at the location in the bag where the rod extends from the bag, the guide member surrounding the rod to guide the rod during extending and retracting movement, the guide member including a sleeve extending into the slot at one end of the channel; and a resilient member connected to the sleeve and engaging the rod to induce lateral frictional resistance to the movement of the rod.

31. A wheeled luggage bag as defined in claim 30 further comprising:

a bumper member positioned in the slot at an opposite end of the channel from the sleeve, the bumper member limiting the maximum amount of retracted movement of the rod; and wherein:

the slider member contacts the sleeve to limit the maximum amount of extended movement of the rod.

* * * * *